US006474742B1

(12) United States Patent
Robinson

(10) Patent No.: US 6,474,742 B1
(45) Date of Patent: Nov. 5, 2002

(54) APPENDAGE CRAMP RELIEF DEVICE

(76) Inventor: Earlene D. Robinson, 1838 Calistoga St., Pittsburgh, PA (US) 15221

( * ) Notice: Subject to any disclaimer, the term of this patent is extended or adjusted under 35 U.S.C. 154(b) by 0 days.

(21) Appl. No.: 09/802,573

(22) Filed: Mar. 9, 2001

(51) Int. Cl.[7] ..... A47C 16/00
(52) U.S. Cl. ..... 297/423.45; 280/205
(58) Field of Search ..... 280/242.1, 200, 280/205; 297/423.1, 338, 423.39, 423.41, 423.44, 423.45, 463.1

(56) References Cited

U.S. PATENT DOCUMENTS 740,071 A * 9/1903 Allen
1,248,358 A * 11/1917 McLaughlin
2,850,081 A 9/1958 Dillon
2,869,620 A 1/1959 Gleitsman
2,912,046 A 11/1959 Fuerst
3,520,572 A * 7/1970 Flaugh
3,633,967 A * 1/1972 Timmins
3,695,684 A 10/1972 Barberg
3,696,826 A * 10/1972 Gruzalski
4,046,348 A * 9/1977 Goodwin
5,054,144 A 10/1991 Stuart et al.
5,269,157 A * 12/1993 Ciminelli et al.
D381,821 S 8/1997 Miles
6,089,667 A * 7/2000 Hobbs

* cited by examiner

*Primary Examiner*—Milton Nelson, Jr.

(57) ABSTRACT

A appendage cramp relief device for aiding in the relief of cramps in the appendages of the user during extended medical treatment sessions. The appendage cramp relief device includes a base which is designed for resting on a support surface, a stanchion upwardly extending from a top of the base such that the stanchion is centered on the top of the base thus the base provides support for the stanchion, and an appendage pad which is adjustably coupled to an upper end of the stanchion such that the appendage pad is designed to adjust to a height proximate to the appendage of the user thus the user can press the appendage against the appendage pad to relieve cramping.

5 Claims, 1 Drawing Sheet

APPENDAGE CRAMP RELIEF DEVICE

BACKGROUND OF THE INVENTION

1. Field of the Invention

The present invention relates to foot rests and more particularly pertains to a new appendage cramp relief device for aiding in the relief of cramps in the appendages of the user during extended medical treatment sessions.

2. Description of the Prior Art

The use of foot rests is known in the prior art. More specifically, foot rests heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,695,684; U.S. Pat. No. 2,912,046; U.S. Pat. No. 2,850,081; U.S. Pat. No. 2,869,620; U.S. Pat. No. 5,054,144; and U.S. Pat. No. Des. 381,821.

While these devices fulfill their respective, particular objectives and requirements, the aforementioned patents do not disclose a new appendage cramp relief device. The inventive device includes a base which is designed for resting on a support surface, a stanchion upwardly extending from a top of the base such that the stanchion is centered on the top of the base thus the base provides support for the stanchion, and an appendage pad which is adjustably coupled to an upper end of the stanchion such that the appendage pad is designed to adjust to a height proximate to the appendage of the user thus the user can press the appendage against the appendage pad to relieve cramping.

In these respects, the appendage cramp relief device according to the present invention substantially departs from the conventional concepts and designs of the prior art, and in so doing provides an apparatus primarily developed for the purpose of aiding in the relief of cramps in the appendages of the user during extended medical treatment sessions.

SUMMARY OF THE INVENTION

In view of the foregoing disadvantages inherent in the known types of foot rests now present in the prior art, the present invention provides a new appendage cramp relief device construction wherein the same can be utilized for aiding in the relief of cramps in the appendages of the user during extended medical treatment sessions.

The general purpose of the present invention, which will be described subsequently in greater detail, is to provide a new appendage cramp relief device apparatus and method which has many of the advantages of the foot rests mentioned heretofore and many novel features that result in a new appendage cramp relief device which is not anticipated, rendered obvious, suggested, or even implied by any of the prior art foot rests, either alone or in any combination thereof.

To attain this, the present invention generally comprises a base which is designed for resting on a support surface, a stanchion upwardly extending from a top of the base such that the stanchion is centered on the top of the base thus the base provides support for the stanchion, and an appendage pad which is adjustably coupled to an upper end of the stanchion such that the appendage pad is designed to adjust to a height proximate to the appendage of the user thus the user can press the appendage against the appendage pad to relieve cramping.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new appendage cramp relief device apparatus and method which has many of the advantages of the foot rests mentioned heretofore and many novel features that result in a new appendage cramp relief device which is not anticipated, rendered obvious, suggested, or even implied by any of the prior art foot rests, either alone or in any combination thereof.

It is another object of the present invention to provide a new appendage cramp relief device which may be easily and efficiently manufactured and marketed.

It is a further object of the present invention to provide a new appendage cramp relief device which is of a durable and reliable construction.

An even further object of the present invention is to provide a new appendage cramp relief device which is susceptible of a low cost of manufacture with regard to both materials and labor, and which accordingly is then susceptible of low prices of sale to the consuming public, thereby making such appendage cramp relief device economically available to the buying public.

Still yet another object of the present invention is to provide a new appendage cramp relief device which provides in the apparatuses and methods of the prior art some of the advantages thereof, while simultaneously overcoming some of the disadvantages normally associated therewith.

Still another object of the present invention is to provide a new appendage cramp relief device for aiding in the relief of cramps in the appendages of the user during extended medical treatment sessions.

Yet another object of the present invention is to provide a new appendage cramp relief device which includes a base which is designed for resting on a support surface, a stanchion upwardly extending from a top of the base such that the stanchion is centered on the top of the base thus the base provides support for the stanchion, and an appendage pad which is adjustably coupled to an upper end of the stanchion such that the appendage pad is designed to adjust to a height proximate to the appendage of the user thus the user can press the appendage against the appendage pad to relieve cramping.

Still yet another object of the present invention is to provide a new appendage cramp relief device that can be adjusted for the height of the user.

Even still another object of the present invention is to provide a new appendage cramp relief device that can be rolled to wherever it is needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
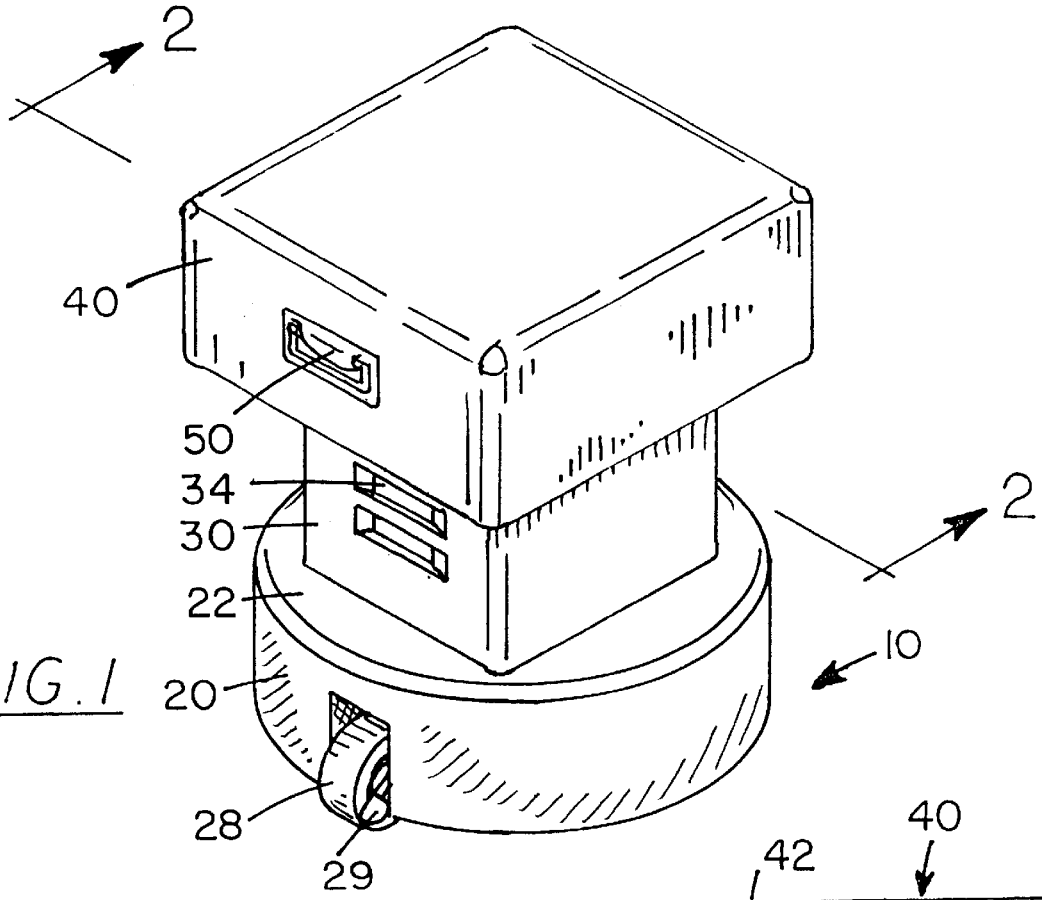
FIG. 1 is a schematic perspective view of a new appendage cramp relief device according to the present invention.
Figure 2:
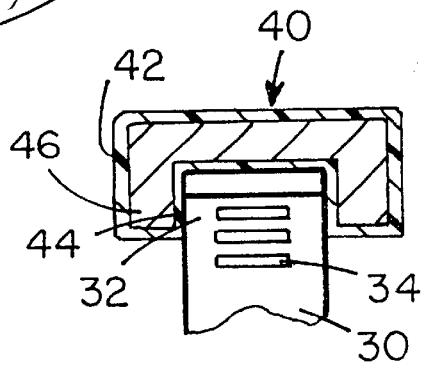
FIG. 2 is a schematic cross-sectional view of the present invention taken along line 2—2 of FIG. 1.
Figure 3:
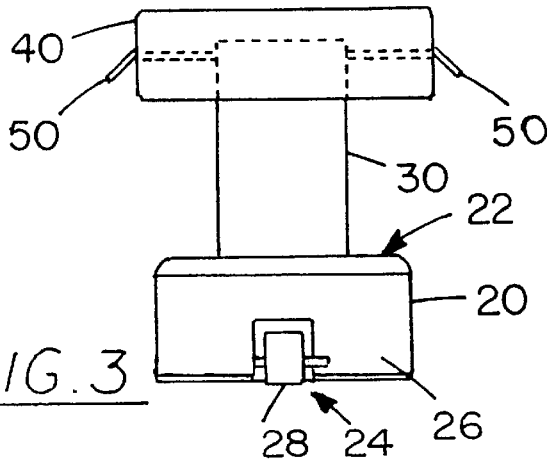
FIG. 3 is a schematic side view of the present invention.

With reference now to the drawings, and in particular to FIGS. 1 through 3 thereof, a new appendage cramp relief device embodying the principles and concepts of the present invention and generally designated by the reference numeral 10 will be described.

As best illustrated in FIGS. 1 through 3, the appendage cramp relief device 10 generally comprises a base 20, a stanchion 30, and an appendage pad 40.

The base 20 is designed for resting on a support surface.

The stanchion 30 extends upward from a top 22 of the base 20 such that the stanchion 30 is centered on the top 22 of the base 20. Thus the base 20 provides support for the stanchion 30.

The appendage pad 40 is adjustably coupled to an upper end 32 of the stanchion 30 such that the appendage pad 40 is designed to adjust to a height proximate to the appendage of the user. Thus the user can press the appendage against the appendage pad 40 to relieve cramping.

The base 20 has a wheel slot 24, which extends through a perimeter wall 26 of the base 20. A wheel 28 is rotatably coupled to the perimeter wall 26 of the base 20 such that the wheel 28 is positioned within the wheel slot 24. Thus the base 20 can be tipped onto the wheel 28 and wheeled to a new position.

The wheel 28 has a wheel locking assembly 29, which is coupled to the wheel 28 such that the wheel locking assembly 29 is selectively engagable to prevent the wheel 28 from rotating. Thus the base 20 is prevented from being moved on the wheel 28.

Each one of a pair of latching assemblies 50 is coupled to a side of the appendage pad 40 such that each of the latching assemblies 50 extends through the side of the appendage pad 40 for releasably engaging a plurality of detents 34 in opposing sides of the stanchion 30. Thus the latching assemblies 50 permit adjustment of the height of the appendage pad 40 in relation to the base 20.

The appendage pad 40 has an outer covering 42 and an interior frame 44. The interior frame 44 is for receiving a portion of the stanchion 30. The covering 42 is coupled to the interior frame 44 such that a padding 46 is positioned between the interior frame 44 and the covering 42 for providing soft surface for the user to push the appendage against.

In use, the height of the appendage cramp relief device is adjusted for the user by engaging the latching assemblies into the associated detents of the stanchion. The appendage cramp relief device is wheeled into position and the user may then press an appendage against the appendage pad to ease cramping of the appendage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An appendage cramp relief device for allowing a dialysis patient to press an appendage against to relieve a cramp, said appendage cramp relief device comprising:

a base being adapted for resting on a support surface;

a stanchion upwardly extending from a top of said base such that said stanchion is centered on said top of said base whereby said base provides support for said stanchion;

an appendage pad being adjustably coupled to an upper end of said stanchion such that said appendage pad is adapted to adjust to a height proximate to the appendage of the user whereby the user can press the appendage against said appendage pad to relieve cramping;

said base has a wheel slot extending through a perimeter wall of said base; and a wheel being rotatably coupled to said perimeter wall of said base such that said wheel is positioned within said wheel slot whereby said base can be tipped onto said wheel and wheeled to a new position, said perimeter wall being positioned on opposing sides of said wheel such that said perimeter wall inhibits contact with said wheel for inhibiting said wheel from being damaged, said wheel being aligned with a longitudinal axis of said stanchion for balancing the weight of said base, said stanchion and said appendage pad over said wheel for facilitating steering when said base is tipped and wheeled to the new position.

2. The appendage cramp relief device as set forth in claim 1, wherein said appendage pad has an outer covering and an interior frame, said interior frame being for receiving a portion of said stanchion, said covering being coupled to said interior frame such that a padding is positioned between said interior frame and said covering for providing soft surface for the user to push the appendage against.

3. The appendage cramp relief device as set forth in claim 1, wherein said wheel has a wheel locking assembly coupled to said wheel such that said wheel locking assembly is selectively engagable to prevent said wheel from rotating whereby said base is prevented from being moved on said wheel.

4. The appendage cramp relief device as set forth in claim 1, further comprising:

a pair of latching assemblies each being coupled to a side of said appendage pad such that each of said latching assemblies extends through said side of said appendage pad for releasably engaging a plurality of detents in opposing sides of said stanchion whereby said latching assemblies permit adjustment of the height of said appendage pad in relation to said base.

5. An appendage cramp relief device for allowing a dialysis patient to press an appendage against to relieve a cramp, said appendage cramp relief device comprising:

a base being adapted for resting on a support surface;

a stanchion upwardly extending from a top of said base such that said stanchion is centered on said top of said base whereby said base provides support for said stanchion;

an appendage pad being adjustably coupled to an upper end of said stanchion such that said appendage pad is adapted to adjust to a height proximate to the appendage of the user whereby the user can press the appendage against said appendage pad to relieve cramping;

said base has a wheel slot extending through a perimeter wall of said base;

a wheel being rotatably coupled to said perimeter wall of said base such that said wheel is positioned within said wheel slot whereby said base can be tipped onto said wheel and wheeled to a new position;

said wheel has a wheel locking assembly coupled to said wheel such that said wheel locking assembly is selectively engagable to prevent said wheel from rotating whereby said base is prevented from being moved on said wheel;

a pair of latching assemblies each being coupled to a side of said appendage pad such that each of said latching assemblies extends through said side of said appendage pad for releasably engaging a plurality of detents in opposing sides of said stanchion whereby said latching assemblies permit adjustment of the height of said appendage pad in relation to said base; and said appendage pad has an outer covering and an interior frame, said interior frame being for receiving a portion of said stanchion, said covering being coupled to said interior frame such that a padding is positioned between said interior frame and said covering for providing soft surface for the user to push the appendage against.

* * * * *